US006205306B1

(12) United States Patent
Ishida

(10) Patent No.: US 6,205,306 B1
(45) Date of Patent: Mar. 20, 2001

(54) ELECTROPHOTOGRAPHIC APPARATUS

(75) Inventor: Tomohito Ishida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/335,491

(22) Filed: Jun. 18, 1999

(30) Foreign Application Priority Data

Jun. 18, 1998 (JP) ..... 10-189759
Jun. 11, 1999 (JP) ..... 11-202129

(51) Int. Cl.[7] ..... G03G 15/16; G03G 21/00
(52) U.S. Cl. ..... 399/128; 399/296
(58) Field of Search ..... 399/46, 51, 66, 399/296, 159, 128

(56) References Cited

U.S. PATENT DOCUMENTS

| | | | | |
|---|---|---|---|---|
| 3,984,182 | * | 10/1976 | Gundlach et al. | 399/296 |
| 4,536,082 | * | 8/1985 | Motohashi et al. | 399/296 |
| 4,853,736 | * | 8/1989 | Goto et al. | 399/296 |
| 5,306,586 | * | 4/1994 | Pai et al. | 430/58 |
| 5,481,345 | * | 1/1996 | Ishida et al. | 399/296 |
| 5,614,998 | * | 3/1997 | Sanpe | 399/296 X |
| 5,749,029 | * | 5/1998 | Umeda | 399/128 |
| 5,942,361 | * | 8/1999 | Hoshizaki et al. | 399/159 X |
| 6,002,901 | * | 12/1999 | Hoshizaki et al. | 399/159 |

FOREIGN PATENT DOCUMENTS

| | | | |
|---|---|---|---|
| 59-024868 | * | 2/1984 | (JP) . |
| 1-169454 | | 7/1989 | (JP) . |
| 1-172863 | | 7/1989 | (JP) . |

* cited by examiner

*Primary Examiner*—William J. Royer
(74) *Attorney, Agent, or Firm*—Fitzpatrick, Cella, Harper & Scinto

(57) ABSTRACT

An electrophotographic apparatus includes a photosensitive member and an electrostatic image forming apparatus for forming an electrostatic image on the photosensitive member. The electrostatic image forming apparatus includes a charging device for electrically charging the photosensitive member and an exposure device for exposing the photosensitive member charged by the charging device. A developing device forms a toner image by developing the electrostatic image with toner. A transfer device electrostatically transfers the toner image onto a transfer material, wherein the photosensitive member has characteristics such that a rate of change of surface potential of the photosensitive member relative to a change of an exposure amount of the photosensitive member, is smaller in the case of a first exposure amount than in the case of a second exposure amount which is larger than in the first exposure amount. A reducing device reduces a potential difference between a potential of the photosensitive member at the portion to which the toner is deposited and the potential of the photosensitive member of a portion to which the toner is not deposited after a developing operation of the developing device and before a transfer operation of the transfer device.

12 Claims, 11 Drawing Sheets

ELECTROPHOTOGRAPHIC APPARATUS

FIELD OF THE INVENTION AND RELATED ART

The present invention relates to an electrophotographic apparatus employed in, for example, a copying machine, a printer, a facsimile, and a publishing system.

Among image forming apparatuses, a laser printer which employs an electrophotographic system has been known as a high speed, low noise printer.

Referring to FIG. 12, which depicts the general structure of a typical conventional laser beam printer, a photosensitive drum 1 (photosensitive member) is rotatively driven in the direction indicated by an arrow mark R1. As it is rotatively driven, the peripheral surface of the photosensitive drum 1 is charged by a charging device 2 (rotated in the direction indicated by an arrow mark R2), is exposed by an exposing means 3, and is subjected to a development process carried out by the development roller 4*a* (rotated in the direction indicated by an arrow mark R4) of a developing device 4. As a result, a toner image is formed on the peripheral surface of the photosensitive drum 1. This toner image is transferred onto a piece of transfer medium P (for example, paper) by a transferring apparatus 5 (rotated in the direction indicated by an arrow mark R5). After being transferred onto the transfer medium P, the toner image is fixed to the surface of the transfer medium P by a fixing device 7. After the toner image transfer onto the recording medium P, the toner (transfer residual toner) remaining on the peripheral surface of the photosensitive drum 1 is removed by a cleaning apparatus 6, in order to prepare the photosensitive drum 1 for the following cycle of image formation process.

The aforementioned laser beam printer employs a binary system, a system based on whether or not a given spot on the peripheral surface of the photosensitive drum 1 is to be exposed to a laser or pictorial shapes. If a laser beam printer is intended for recording only an image such as a letter, it does not need to record in intermediary tone, and therefore, its structure can be simple. As is known, it is possible to reproduce intermediary tone with the use of a printer of a binary recording type, as long as it is used with an intermediary tone reproduction method, such as a dither method or a density pattern method, which reproduces intermediary tone on the basis of dot area ratio. However, a printer which employs a dither method, a density pattern method, or the like suffers from a problem that it can not print in high resolution.

Thus, an image forming apparatus based on a pulse width modulation system (PWM system) has been proposed. According to this PWM system, intermediary tone is reproduced by each picture element, making it possible to record in high resolution without reducing recording density. More specifically, a PWM system based image forming apparatus forms picture elements with intermediary tone by changing the length of time an exposure laser beam is turned on in response to image signals. Since it is capable of forming a high resolution image with excellent tone gradation, its superiority becomes more apparent when forming a full-color image. Elaborating further, according to the aforementioned PWM system, in order to reproduce intermediary tone, the area ratio can be changed for each dot created per picture element by a laser beam spot, making it possible to reproduce intermediary tone without reducing resolution.

However, in the case of a PWM system based image forming apparatus, as picture element density is increased, the size of each picture element becomes smaller relative to the diameter of a beam spot, which creates a problem in that intermediary tone can not be satisfactorily reproduced by changing the length of time an exposure beam is turned on.

In order to improve resolution while maintaining tone gradation, it is necessary to reduce the beam spot diameter. For example, when a laser based optical scanning system is employed, it is necessary to reduce the wave length of the laser beam, to increase the NA of the f-θ lens, or to take the like measures. In order to employ these measures, an expensive laser must be used. Further, as a lens or a scanner is increased in size, mechanical accuracy must be improved to compensate for the reduction in focal depth. In other words, a PWM has a problem in that when it is employed, the increase in the apparatus size and cost cannot be avoided. Also in the case of a solid state scanner such as an LED array or a liquid crystal shutter array, there is the same problem: cost increase cannot be avoided because of the high prices of these scanners, the cost increase for the improvement in the accuracy with which the scanner must be mounted, and the cost increase for the electrical circuit for driving these scanners.

Recently, regardless of the problems described above, the demand for the increase in resolution and the level of tone gradation achievable by an electrophotographic system based image forming apparatus has been rapidly increasing.

In an attempt to accommodate such demand, Japanese Laid-Open Patent Application Nos. 169,454/1989 and 172,863/1989, for example, proposed the usage of a photosensitive drum characterized in that its sensitivity is low when the amount of exposure light is low, and increases as the amount of exposure light increases. With the use of such a photosensitive drum, in each exposure spot which displays a certain light intensity distribution pattern, the areas with low intensity are ignored so that the same effects as those obtained when the exposure spot diameter is reduced can be obtained. In this specification, a photosensitive member capable of producing such effects is called an induction type photosensitive member. The employment of an induction type photosensitive member as the photosensitive member for an image forming apparatus in which the photosensitive member is exposed to a scanning exposure spot with a light intensity distribution pattern, made it possible to achieve a resolution level higher than what was expected from the diameter of the exposure spot. When an electrostatic latent image formed on a photosensitive member with a high level of surface charge density was developed through the application of a high frequency development bias, a strong electric field was created on the peripheral surface of the photosensitive member due to the high level of charge density. As a result, not only relatively large image patterns such as lines or letters, but also image patterns constituted of a plurality of independent dots, such as the pattern in the half tone portions of a picture image, could be formed in an extremely high toner density.

However, in order to transfer by a transferring apparatus, the toner particles held fast to the photosensitive member by an extremely strong force, the toner particles on the photosensitive drum, which constitute the toner image, must be ripped away from the photosensitive member with the use of a strong transfer electric field. As a transfer electric field is strengthened, transfer efficiency increases. However, if the strength of a transfer electric field exceeds a certain level, electrical discharge or the like occurs which causes toner particles to aggregate, resulting in reduction in image quality. Normally, in the formation of an image of any pattern, the strength of the transfer electric field is set to strike an optimal balance between transfer efficiency and dot reproduction. However, when the aforementioned induction type photosensitive member is employed, a resultant toner image displays a high level of toner density and is excellent in terms of sharpness of contour while it is on the peripheral surface of the photosensitive drum, but while, or after, it is transferred onto a piece of transfer medium, it suffers from the problem that the toner particles scatter from the image, or the image fails to be satisfactorily transferred. In other words, a satisfactory image cannot be outputted.

SUMMARY OF THE INVENTION

The present invention was made in consideration of the above described issues, and its primary object is to provide an image forming apparatus in which a highly precise toner image is formed on the photosensitive member by the function of the strong electric field generated during the development period, and is successfully transferred onto a piece of transfer medium without the scattering of toner, so that a copy which does not suffer from the effects of the scattering of toner, or an unsatisfactory image transfer, can be produced.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIGS. 3(*c*) and 3(*d*), are graphic drawings which show the charge distribution pattern, and the potential distribution pattern, which occur on the peripheral surface of an induction type photosensitive member, when a beam of light with a nonuniform intensity distribution pattern is projected onto the photosensitive member.

FIG. 5(*b*), is a schematic three dimensional drawing which shows the distribution pattern of the electric field, before the electric field which held fast the toner particles to the peripheral surface of the photosensitive member was virtually eliminated by reducing, by pretransfer exposure, the potential level across the portions of the peripheral surface of the photosensitive member, which had not been exposed during the formation of a latent image, so that the toner particles on the photosensitive member could be easily transferred by the application of transfer field.

FIG. 9(*c*) is the toner image on the transfer medium when the photosensitive member was exposed prior to transfer, in the first embodiment.

DESCRIPTION OF THE PREFERRED EMBODIMENTS

Hereinafter, the embodiments of the present invention will be described with reference to the appended drawings.

Embodiment 1

Figure 1:
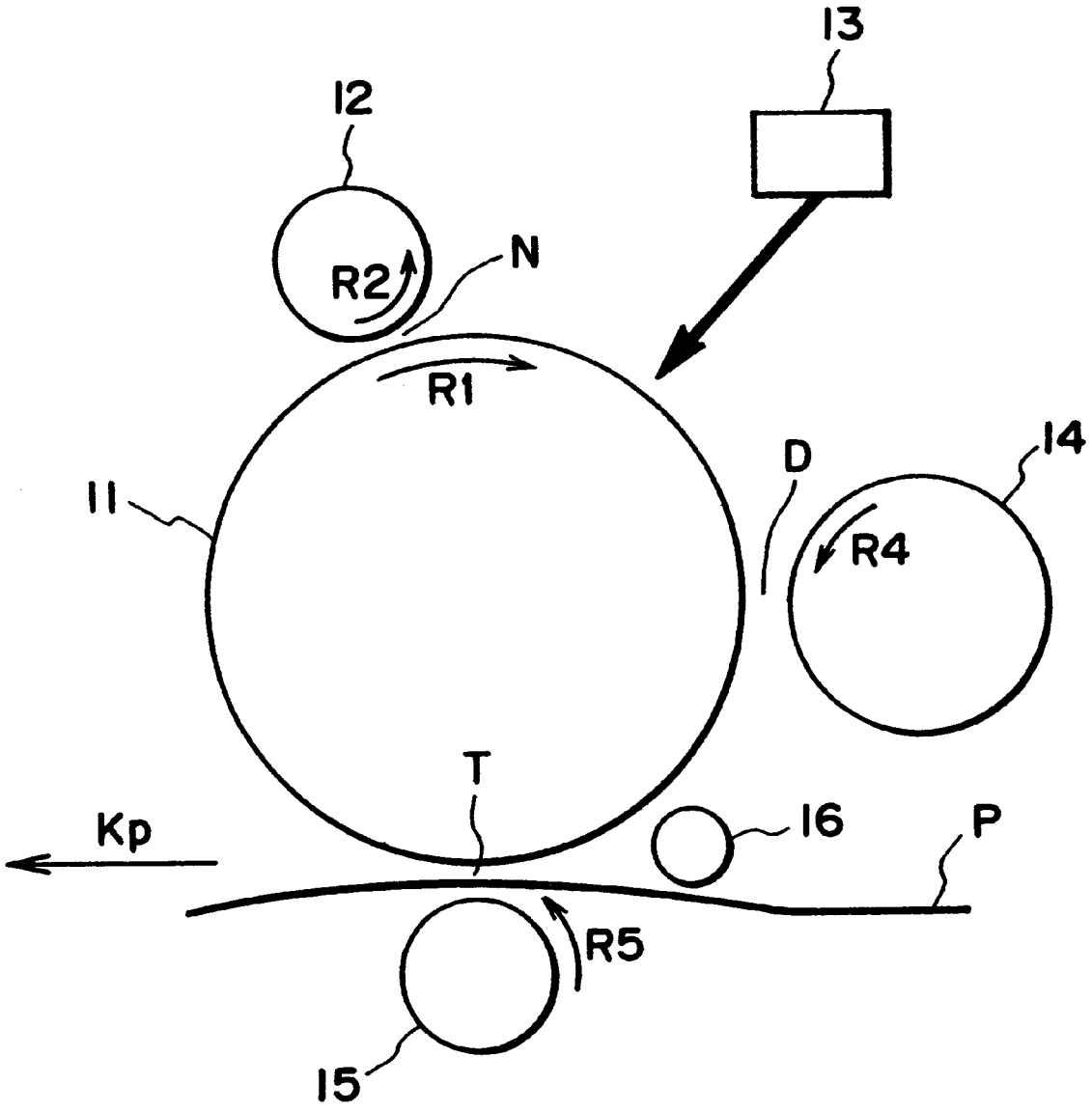
FIG. 1 is a schematic sectional view of the image forming apparatus in the first embodiment of the present invention, and depicts the general structure of the apparatus.

FIG. 1 depicts an example of an image forming apparatus compatible with the present invention. The drawing is a schematic vertical sectional view of a laser beam printer, and depicts the general structure of the apparatus.

The laser beam printer (hereinafter, "image forming apparatus") illustrated in FIG. 1 comprises an electrophotographic photosensitive member 11 (hereinafter, simply, "photosensitive member") in the form of a drum. The photosensitive drum in this embodiment is a special one, and its characteristics or the like will be described later in detail. The photosensitive drum 11 is rotatively driven in the direction indicated by an arrow mark R1 by an unillustrated driving means. As the photosensitive member 11 is rotatively driven, its peripheral surface is uniformly charged by a charging device 12 for primary charge to predetermined polarity and potential level, and then, is exposed to a beam of light projected from an exposing means 13 while being modulated with image formation data. As a result, an electrostatic latent image is formed on the peripheral surface of the photosensitive member 11. To this electrostatic latent image, toner is adhered by the development sleeve 14 of a developing apparatus; the latent image is developed into a toner image. The toner image on the photosensitive member 11 is transferred by a transferring device 15, onto a piece of transfer medium P, for example, a sheet of paper, which is being conveyed in the direction indicated by an arrow mark $K_P$ by a conveying means (unillustrated). After the toner image transfer, the toner image on the transfer medium P is fixed to the surface of the transfer medium P through the application of heat and pressure by a fixing device (unillustrated). Finally, the transfer medium P is discharged out of the main assembly of the image forming apparatus. Meanwhile, the toner (transfer residual toner) which remained on the photosensitive member 11 after the toner image transfer, that is, the toner which was not transferred onto the transfer medium P, is removed by a cleaning apparatus (unillustrated), in order to prepare the photosensitive member 11 for the following cycle of image formation.

In this embodiment, prior to the toner image transfer, the potential level on the peripheral surface of the photosensitive member 11 is further reduced by an optical means for reducing the potential level difference. More specifically, the potential level difference on the peripheral surface of the photosensitive member can be reduced by reducing the surface potential of the photosensitive member by exposing the peripheral surface of the photosensitive member to the exposure light, the amount of which is greater than the amount correspondent to the point on the attenuation curve in FIG. 2, which corresponds to the peak of the curve obtained by the second order differentiation of the smaller exposure light amount side, relative to the point I, of the attenuation curve in FIG. 2, but smaller than the amount correspondent to the point on the attenuation curve in FIG. 2, which corresponds to the peak of the curve obtained by the second order differentiation of the greater exposure light amount side, relative to the point I, of the attenuation curve in FIG. 2.

The interfaces between the aforementioned charging device 12 for primary charge, development sleeve 14, and transferring apparatus 15, and the photosensitive member 11, constitute a charge nip N, a development nip D, and a transfer nip T, in the stated order.

Next, the gist of the present invention will be described.

Figure 2:
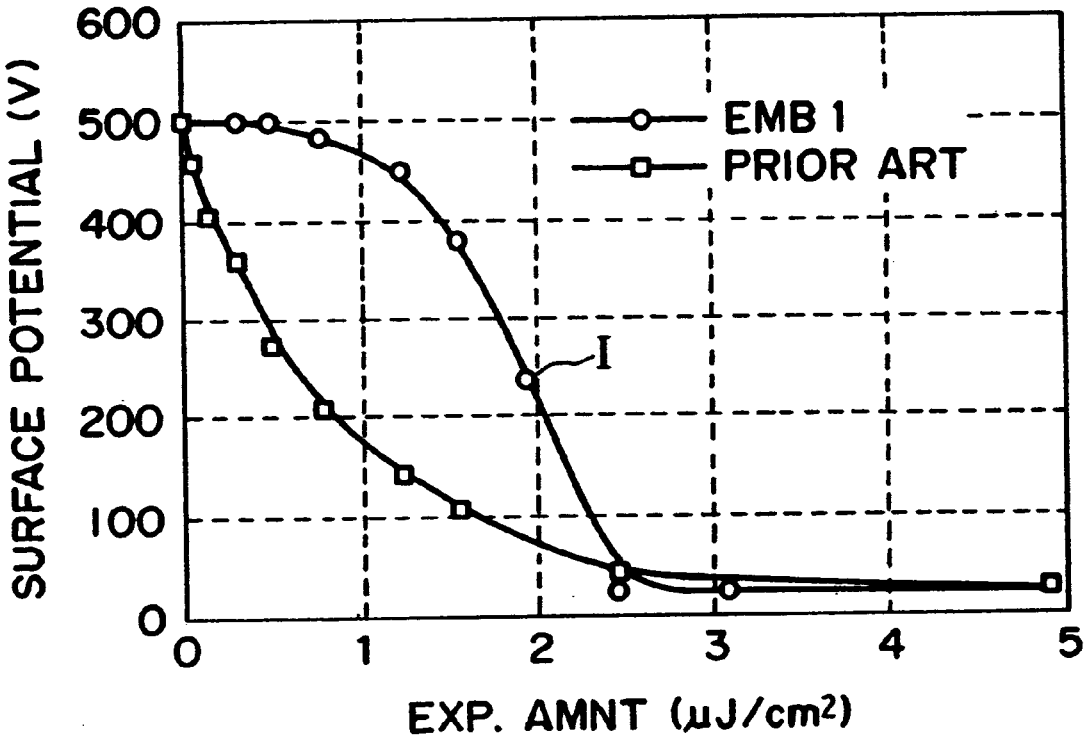
FIG. 2 is a graph which shows the relationship between the amount of exposure light per unit area of the peripheral surface of the induction type photosensitive drum, and the surface potential level of the photosensitive member.
Figure 3A:
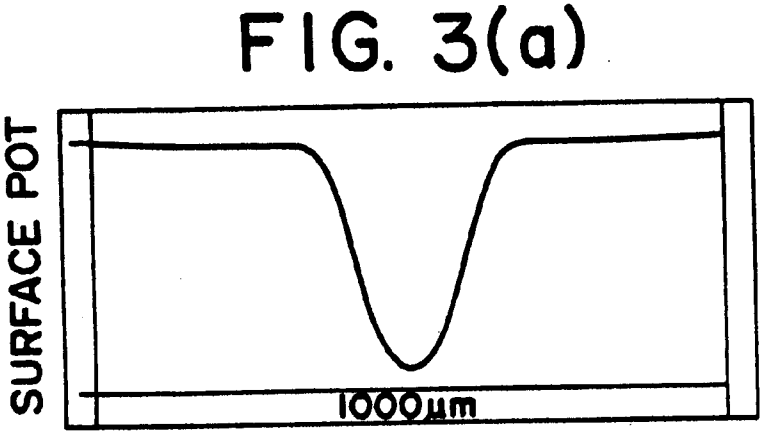
FIGS. 3(*a*) and 3(*b*), are graphic drawings which show the charge distribution pattern, and the potential distribution pattern, which occur on the peripheral surface of a photosensitive member characterized in that the relationship between the amount of exposure light projected onto the photosensitive member and the resultant surface potential level is linear, when a beam of light with a nonuniform intensity distribution pattern is projected onto the photosensitive member.
Figure 3B:
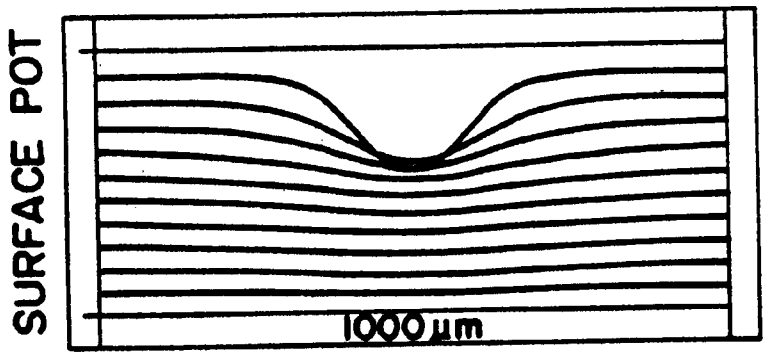
Figure 3C:
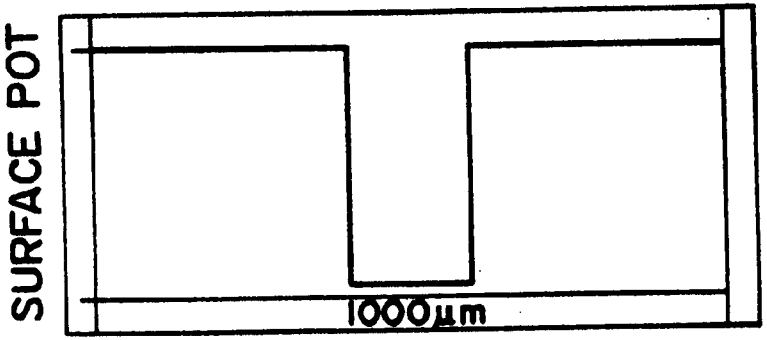
Figure 3D:
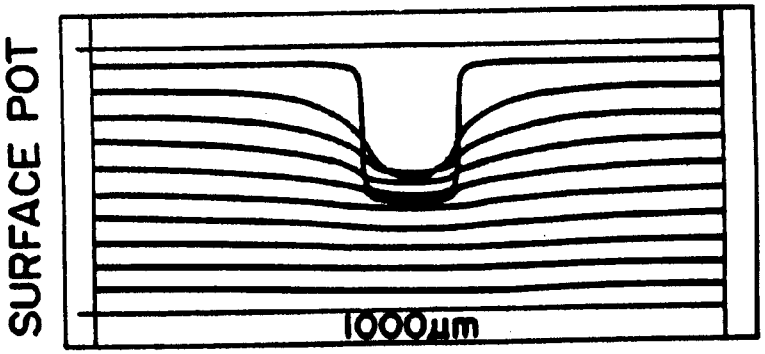

First, the concept of the present invention will be described with reference to the drawings. FIG. 2 is a graph which shows the relationship between the amount of light (unit of measurement is "$\mu J/cm^2$") to which an induction type photosensitive member is exposed per unit area of its peripheral surface, and the surface potential level (unit of measurement is "V"), in the form of an attenuation curve.

Referring to FIG. 2, the sensitivity (ratio of surface potential level change relative to the amount of exposure light) of the induction type photosensitive drum in this embodiment is low when it is subjected to a relatively smaller dosage of exposure light, but becomes high when it is subjected to a large dosage of exposure light. In other words, as the amount of exposure light increases, the surface potential level decreases as shown in FIG. 2. However, the relationship between the amount of the exposure light and the decrease in the potential level on the peripheral surface of the photosensitive member 11 is not linear. Thus, when the relationship between the amount of exposure light and the potential level is shown in the form of a graph, it manifests in the form of the curved line (attenuation curve) in FIG. 2, which has a point I at which the curvature of the line changes in direction; on the left side of the point I, the line bulges upward, whereas, on the right side of the point I, it bulges downward. Further, in the case of a beam of exposure light with a diameter equivalent to the size of a single dot for a given resolution, a substantial portion of the exposure light, the intensity of which is equivalent to 10% of the peak of the intensity distribution pattern, is on the smaller exposure amount side, relative to the aforementioned point I, in FIG. 2. Therefore, when the induction type photosensitive member 11 is exposed to a beam of light which comprises light with high intensity to light with low intensity, in other words, a beam of light with a certain intensity distribution pattern, the pattern of the charge distribution which occurs on the peripheral surface of the photosensitive member becomes such a pattern as the one depicted in FIG. 3(*c*), that has a step, rectangular valley. FIG. 3(*a*), shows the charge distribution pattern which occurred on a photosensitive drum characterized in that the relationship between the amount of exposure light projected onto the photosensitive member and the resultant surface potential level is linear, when a beam of light with a nonuniform intensity distribution pattern is projected onto the photosensitive member. It is evident that unlike the charge distribution pattern which occurs on the induction type photosensitive member 11, the pattern of the light amount distribution was retained as it was, on the charge distribution pattern. As described above, when the induction type photosensitive member 11 is employed, a charge distribution pattern with a steep valley is formed on the peripheral surface of the photosensitive member. Therefore, the magnitude of the electric field generated next to the peripheral surface of the photosensitive member, in the development spaced between the photosensitive member and the development sleeve, becomes extremely large as shown in FIG. 4(*b*).

Figure 5B:
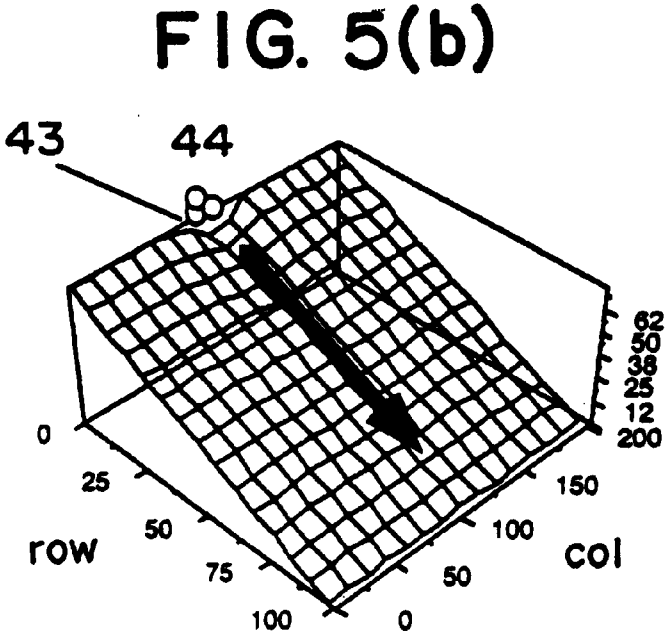
FIG. 5(*a*), is a schematic three dimensional drawing which shows the distribution pattern of the electric field after the electric field which held fast the toner particles to the peripheral surface of the photosensitive member was virtually eliminated by reducing, pretransfer exposure, the potential level across the portions of the peripheral surface of the photosensitive member, which had not been exposed during the formation of a latent image, and the toner particles which were freed from the holding force of the electric field.
Figure 5A:
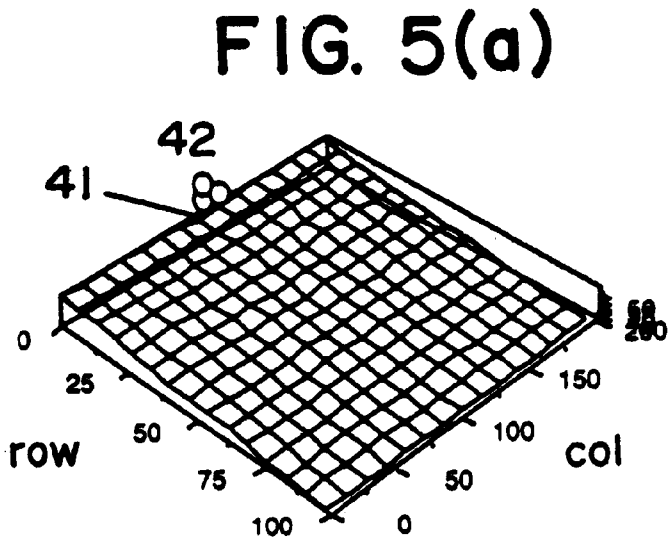
Figure 6:
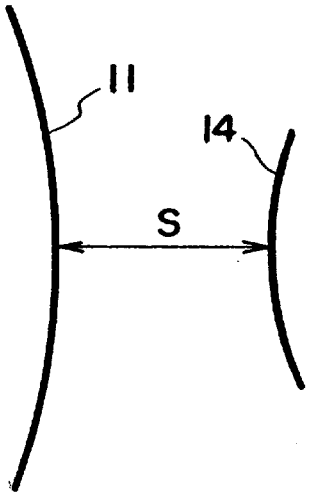
FIG. 6 is a schematic drawing which depicts the development space, the definition of which is essential to comprehend the concept presented by FIGS. 4(*a*) and 4(*b*) and FIGS. 5(*a*) and 5(*b*).
Figure 7:
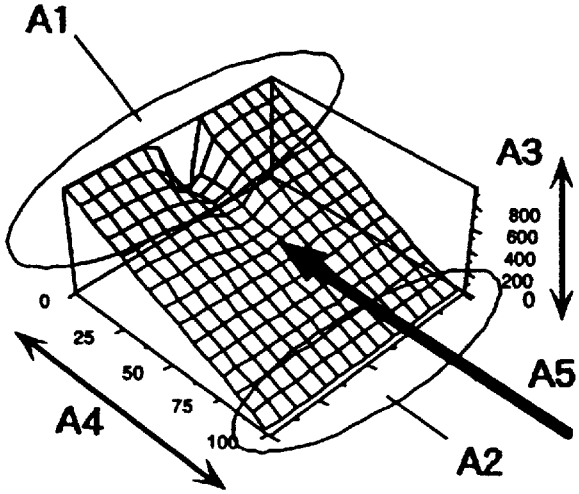
FIG. 7 is a schematic drawing which shows how to comprehend the concept presented by FIGS. 4(*a*) and 4(*b*) and FIGS. 5(*a*) and 5(*b*).

At this time, how to interpret FIGS. 4(*a*) and 4(*b*), and FIGS. 5(*a*) and 5(*b*), will be described with reference to FIGS. 6 and 7. First, it is assumed that a development space is created by the induction type photosensitive member 11 and the development sleeve 14, and the distance between the peripheral surface of the induction type photosensitive member 11 and the development sleeve 14 is a distance of S. Further, it is assumed that the induction type photosensitive member 11 has been charged, and the potential level across the peripheral surface of the induction type photosensitive member 11, within the development space, displays the certain pattern, which is depicted in FIG. 7, on the back side A1 of the drawing. Further, it is assumed that the development sleeve 14, which squarely faces the induction type photosensitive member 11, is on the front side A2 in the drawing. Thus, in the drawing, the distance A4 between the front side A2 and the back side A1 corresponds to the distance S between the induction type photosensitive member 11 and the development sleeve 14, and the points 0 and 100 on the axis which runs in the direction indicated by a double headed arrow mark A4 correspond to the peripheral surfaces of the induction type photosensitive member 11 and the development sleeve 14, respectively. The potential level is represented by the height in the direction indicated by an arrow mark A3, and points 800 and 0 on the axis which runs in the arrow A3 direction correspond to the highest potential level on the development sleeve 14 or the transfer medium P, respectively. Therefore, the inclinations of the surface created by connecting each point representing the potential level in the development space represents the strength of the electrical field at that point.

Figure 8:
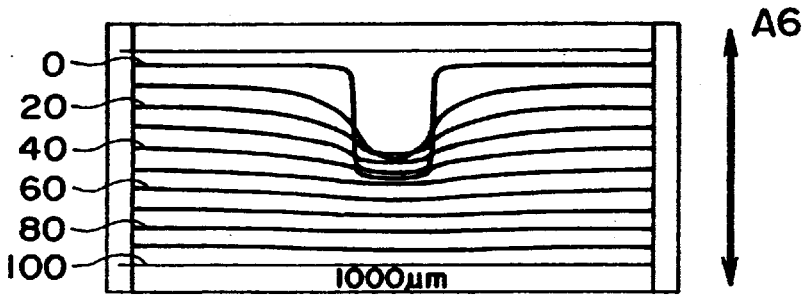
FIG. 8 is a schematic drawing which shows how to comprehend the concept presented by FIGS. 3(*a*), 3(*b*), 3(*c*), and 3(*d*).

Next, FIGS. 3(*a*) and 3(*b*), will be described with reference to FIG. 8. In FIG. 8, the vertical axis represents potential level, and the each curved line represents the potential level at a point which is a certain distance away from the peripheral surface of the induction type photosensitive member 11. The numerical values in FIG. 8 correspond to those in FIG. 7. In other words, the curved line 0 represents the potential level at the peripheral surface of the photosensitive member, and the curved line 20 represents the potential level at a point adjacent to the peripheral surface of the photosensitive member. Similarly, the curved lines 40, 60, and 80 represent the potential levels at points further apart from the peripheral surface of the photosensitive member. The curved line 100 represents the potential level on the peripheral surface of the development sleeve 14.

Figure 4B:
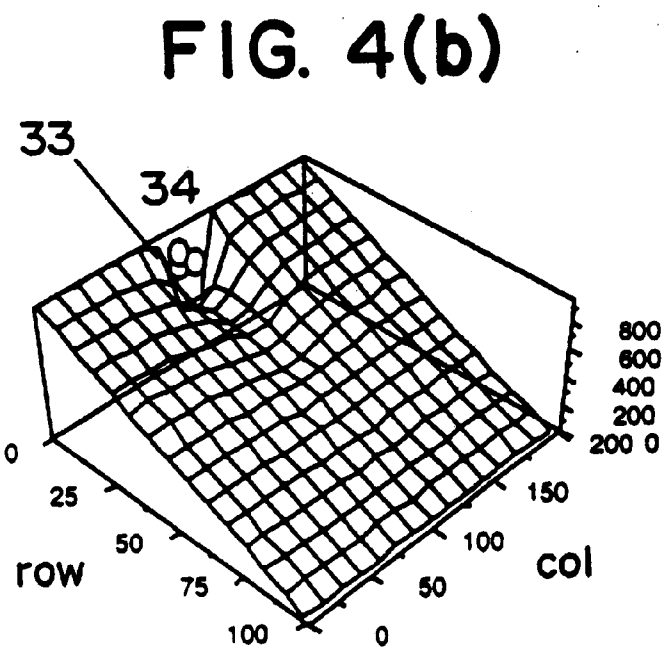
FIG. 4(*a*), is a three dimensional drawing which shows the charge distribution pattern, which occurs when the peripheral surface of the photosensitive drum characterized in that the relationship between the amount of exposure light projected onto the photosensitive member and the resultant surface potential level is linear, when a beam of light with a nonuniform intensity distribution pattern is projected onto the photosensitive member, and the toner particles trapped in one of the colored portions of an image, and FIG. 4(*b*) is a three dimensional drawing which shows the potential distribution pattern, which occurs when a beam of light with nonuniform intensity distribution pattern is projected onto the photosensitive member, and the toner particles trapped in one of the colored portions of an image.
Figure 4A:
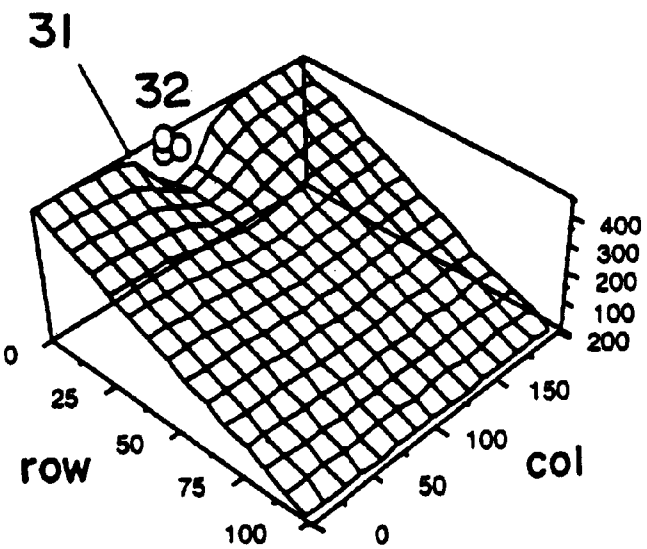

With the information given above regarding the drawings, it is evident from FIG. 4(*b*), and FIG. 3(*d*), that when the induction type photosensitive member 11 was in use, the potential distribution pattern displays a sleep inclination toward the peripheral surface of the photosensitive member; in other words, there is a strong electric field 33 close to the peripheral surface of the photosensitive member.

On the other hand, referring to FIG. 4(*a*), and FIG. 3(*b*), which represent a case in which a photosensitive member characterized in that the relationship between the amount of exposure light projected onto the photosensitive member and the resultant surface potential level is linear, was employed, the potential distribution pattern displays a gentle inclination toward the peripheral surface of the photosensitive member; in other words, the electric field adjacent to the peripheral surface of the photosensitive member was weaker compared to that in the case in which the induction type photosensitive member 11 was employed, and therefore, the force which works in the direction to adhere the toner particles 32 was weak.

As is evident from the above explanation, when an image is formed using the induction type photosensitive member 11, an extremely strong electric field is generated. As a result, an electrostatic latent image on the induction type photosensitive member 11 is developed into a highly precise toner image with a high level of toner density.

However, if the transfer process is carried out while the induction type photosensitive member 11 is left in the state in which the electrostatic latent image could be developed into an excellent toner image by the strong electric field, the toner particles 34 are held fast on the induction type photosensitive member 11 by a strong force which attracts the toner particles 34 toward the photosensitive member, and therefore, they fail to be quickly transferred onto the transfer medium P; they may be badly scattered, and negatively affect image quality.

Thus, according to this embodiment, after the completion of each development process, the peripheral surface of the photosensitive member was exposed to light before starting the transfer process, so that the potential level was reduced across the peripheral surface of the photosensitive member inclusive of the portions which had not been exposed to light during the latent image forming period. As a result, the strong electrical field which was generated immediately adjacent to the peripheral surface of the induction type photosensitive member 11 due to the aforementioned electrical charge distribution pattern which had occurred during each period for forming a latent image was virtually eliminated, turning into the one designated by a referential character 41 in FIG. 5(*a*), so that the toner particles 42 could be easily transferred. As the transfer voltage was applied to the induction type photosensitive member 11 with the reduced potential level, the electrical charge distribution pattern changed into the one illustrated in FIG. 5(*b*), allowing the toner particles 44 on the peripheral surface of the induction type photosensitive member 11 to be efficiently transferred.

Figure 13:
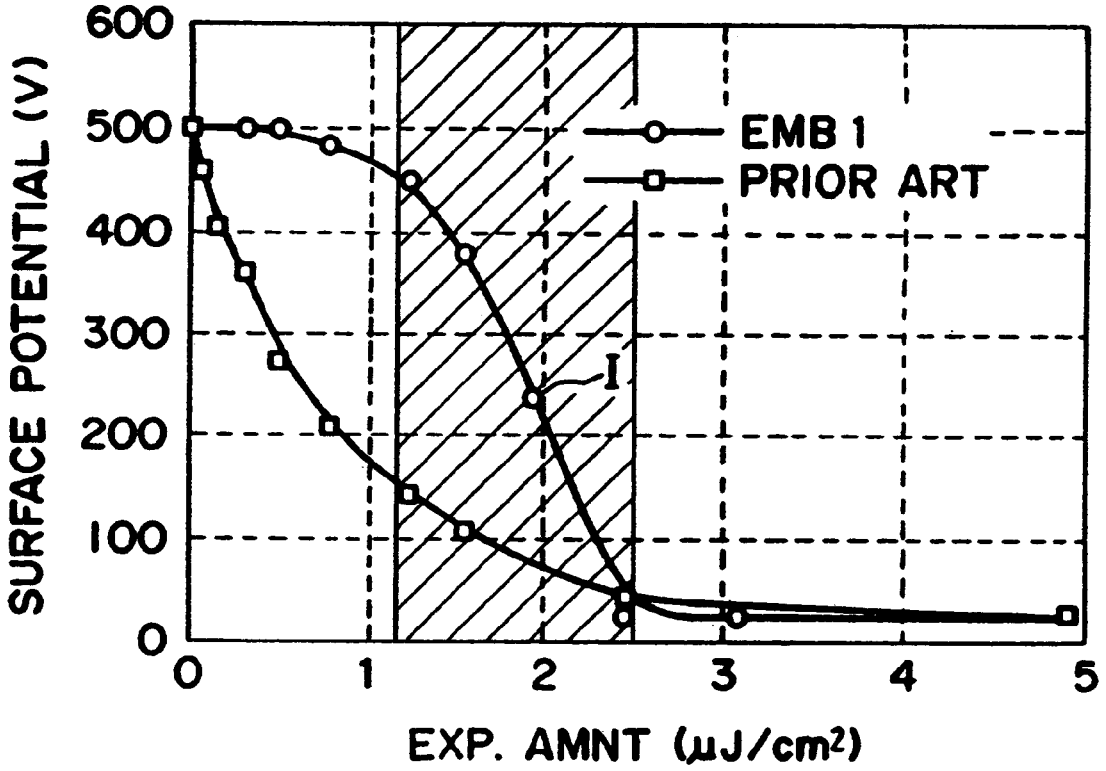
FIG. 13 is a graph which shows a proper amount of exposure light necessary for pre-transfer exposure.

Referring to FIG. 2, the amount of exposure light to be projected onto the photosensitive member for the above described purpose prior to the transfer is desired to be on the large amount side, relative to the point on the attenuation curve in FIG. 2, which corresponds to the peak of the curve obtained by the second order differentiation of the smaller exposure light amount side, relative to the point I, of the attenuation curve in FIG. 2, and also is desired to be on the smaller exposure light amount side, relative to the point on the attenuation curve in FIG. 2, which corresponds to the peak of the curve obtained by the second order differentiation of the larger exposure light amount side, relative to the point I, of the attenuation curve in FIG. 2. In other words, it is ideal that the amount of light to be projected to expose the photosensitive member prior to transfer is within the hatched range in FIG. 13. More specifically, the effects of the pretransfer exposure become the most remarkable when the amount of exposure light to be used for the pretransfer exposure of an induction type photosensitive member corresponds to the peak of the curve obtained by the first order differentiation of the attenuation curve in FIG. 2, which shows the relationship between the amount of exposure light and the potential level on a photosensitive member.

Next, each member related to the present invention will be described in detail.

In this embodiment, an induction type photosensitive member 11 is used as the photosensitive member.

The induction type photosensitive member 11 comprises a base member in the form of a cylindrical drum, and a photosensitive layer placed on the peripheral surface of the base member. The photosensitive layer comprises a charge generation layer and a charge transfer layer.

As for the material for the base member in the form of a drum, electrically conductive materials, for example, aluminum, aluminum alloy, copper, zinc, stainless steel, chrome, titanium, nickel, magnesium, indium, gold, platinum, iron, or the like, can be used. However, the base member may be constituted of a base drum formed of electrically nonconductive dielectric material, for example, plastic, and an electrically conductive thin layer formed on the peripheral surface of the base drum by the deposition of aluminum, indium oxide, tin oxide, gold, or the like. Further, the base member may be formed of compound material created by mixing electrically conductive particles into plastic or paper.

There may be placed between the aforementioned base member and photosensitive layer, an undercoat layer which has an injection preventing function and an adhering function. The undercoating layer may be formed of casein, polyvinyl alcohol, nitrocellulose, copolymer of ethylene and acrylic acid, polyvinyl butyral, phenol resin, polyamide, polyurethane, gelatin, or the like. The thickness of the undercoat layer is desired to be 0.1–10 $\mu$m, preferably 0.3–3 $\mu$m.

As for the material for the photosensitive layer, any material may be used as long as it is inductive, and its inductive efficiency and sensitivity change in response to the change in the magnitude of electrical field. The photosensitive layer may be of two functional layer type comprising the charge generation layer and the charge transfer layer, or may be of a single layer type capable of performing both the charge generating function and the charge transferring function.

As for the material for the charge generation layer, selenium-tellerium, pyrylium dye, tiopyrylium dye, phthalocyanine pigment, anthoanthrone pigment, dibenzpyrenequinone pigment, pyranthrone pigment, triazo pigment, diazo pigment, azo pigment, indigo pigment, quinacridone pigment, cyanine pigment, or the like may be used.

As for the material for the charge transfer layer, hypolymer compound such as poly-N-vinylcarbazole, polystylylanthracene, and the like, which contains heterocyclic rings or condensed polycyclic aromatic groups; heterocyclic compound such as pyrazoline, imidazole, oxazole, oxadiazole, triazole, and carbazole; and low polymer compound, for example, triarylalkane derivative such as triphenylmethane, triarylamine derivative such as triphenylamine, phenylenediamene derivative, N-phenylcarbazole derivative, stilbene derivative, hydrazone derivative, and the like, may be used.

In addition to the materials listed above, binder polymer is used as the material for the charge generation layer and the charge transfer layer. As for the binder polymer, styrene, vinyl acetate, vinyl chloride, acrylic ester, methacrylic ester, vinylidene fluoride, polymer and copolymer of vinyl compound such as trifluoroethylene, polyvinyl alcohol, polyvinyl acetal, polycarbonate, polyester, polysulfone, polyphenylene oxide, polyurethane, cellulose resin, phenol resin, melamine resin, silicon resin, epoxy resin, and the like, can be listed.

Further, additive may be added to the above listed materials for the photosensitive layer to improve mechanical characteristics and durability. As for such additive, oxidization inhibitor, ultraviolet absorbing agent, stabilizing agent, bridge forming agent, lubricant, electrical conductivity controlling agent, or the like, is used.

The induction type photosensitive member 11 used in this embodiment comprises a base member in the form of a drum, and a 20 $\mu$m thick photosensitive layer coated on the peripheral surface of the base member. The material for the photosensitive layer is a compound material composed by dispersing one part in weight of Specifically formulated CuPC pigment (Toyo Ink, Co.) into four parts in weight of hardening resin belonging to polyester-melamine group.

As for the system to be employed by the charging device 12 for primary charge, there are a corona based charging system comprising a corona wire and an electric field controlling grid, and a roller based charging system comprising a charge roller. In the case of the latter system, the charge roller is placed in contact with an induction type photosensitive member 11, and the induction type photosensitive member 11 is charged by the application of bias composed of DC voltage, or compound bias composed of DC voltage and AC voltage. In this embodiment, a charge roller is employed, and the peripheral surface of the photosensitive member is charged to a voltage level of +500 V by applying to the charge roller, a charge bias composed of an AC voltage with a frequency of 950 Hz and a peak-to-peak voltage of 800 $V_{pp}$, and a DC voltage of +500 $V_{DC}$.

As for an optical system as the exposing means 13, there are various types of optical systems which may be used as the exposing means 13; for example, a scanner type which uses a semiconductor laser, a type which exposes the photosensitive member with the light from an LED through a Cellfoc lens as a condenser lens, an EL element type, a plasmic light emitting element type, and the like types. These optical systems can be used along with a tone controlling method based on the PWM system, an area based tone controlling method, a laser intensity modulation method, or a combination of these tone controlling methods.

In this embodiment, a semiconductor laser with a wave length of 680 nm and an output of 5 mW is used. The optical system is a scanner type system. The diameter of the laser beam spot on the induction type photosensitive member 11, more specifically, in terms of the area within which the light intensity is no less than $1/e^2$ of the peak intensity, is 25 $\mu$m in terms of the primary scanning direction, and 45 $\mu$m in terms of the secondary scanning direction. The resolution is 600 dpi.

As for the development system for the developing apparatus, various development systems are compatible with the present invention; for example (1) a noncontact type development system which uses single component magnetic toner, (2) a contact type development system which uses magnetic toner, (3) a noncontact type development system which uses single component nonmagnetic toner, (4) a contact type development system which uses single component nonmagnetic toner, (5) a development system which uses two component toner, and the like. In the system (1), magnetic toner is conveyed by magnetic force, and a latent image is developed by causing the toner to fly onto the photosensitive member 11 in the development nip D. In the system (2), a latent image is developed with the use of magnetic toner by placing the development member in contact with the photosensitive member 11 in the development nip D. In the system (3), nonmagnetic toner is borne on a development sleeve 14 while being charged and regulated by a blade, and is conveyed into a development nip D, in which a latent image is developed by causing the toner to fly onto the photosensitive member 11. In the system (4), single component, nonmagnetic toner is borne on a development sleeve 14, and a latent image is developed by placing the sleeve directly in contact with the photosensitive member 11 in the development nip D. In the system (5), nonmagnetic toner is mixed with carrier which is magnetic powder, and the mixture is carried on the development sleeve 14 into the development nip D, in which a latent image is developed in the same manner as in the system (4). In this embodiment, the system (1), that is, the nonmagnetic development system which uses single component magnetic toner, is employed. The smallest distance between the development sleeve 14 and the photosensitive member 11 is 300 $\mu$m. A latent image is developed by applying a development bias, that is, a compound voltage composed of an AC component with a frequency of 1,800 Hz and a peak-to-peak voltage of 800 $V_{pp}$, and a DC component of 350 $V_{pp}$. The polarity to which the toner is charged is the same as the charge polarity of the charging device 12.

The transfer method to be used in the transferring apparatus 15 may be a system which uses electrical force, or a system which uses mechanical force. As for the transfer method which uses electrical force, there are a corona based transfer method, a roller based transfer method, and the like. In a corona based transfer method, DC bias with the opposite polarity to that of the toner is applied to a corona wire. In a roller based transfer system, a roller with a surface layer formed of a material with an electrical resistance of $10^5$–$10^{12}$ Ω.cm is placed in contact with transfer medium, and then, bias with the opposite polarity to that of toner is applied to the roller.

In this embodiment, a transfer roller was used, and an image was transferred by flowing a transfer current of 2–10 $\mu$A.

In addition, a pretransfer exposure unit (light projecting means) as a potential level reducing means 16 for reducing the difference in potential level between the portions to which toner had adhered and the portions to which no toner had adhered, was disposed in a manner to face the peripheral surface of the photosensitive member 11, along the peripheral surface of the photosensitive member 11, at a point on the downstream side of the development nip D and, but on the upstream side of the transfer nip T, in terms of the rotational direction of the photosensitive member 11. This unit was used to project light on the peripheral surface of the photosensitive member 11 after the development, but prior to the transfer. As for the pretransfer exposure unit choice, a tungsten lamp, an LED, various gas lasers, an organic EL, a fluorescent lamp, a mercury lamp, or the like, which emits light to which the material for the photosensitive layer of the photosensitive member 11 is sensitive, may be used. In view of the durability of the photosensitive member 11, means which have a light wave length within a long wave range are more suitable than those which have a light wave length with a short wave range. In this embodiment, a plurality of small tungsten lamps were disposed in alignment in the longitudinal direction of the photosensitive member 11 (direction of the generatrix of the peripheral surface of the photosensitive member 11) to expose the photosensitive member 11 at a rate of 1.8 $\mu J/cm^2$ prior to the transfer.

Figure 9C:
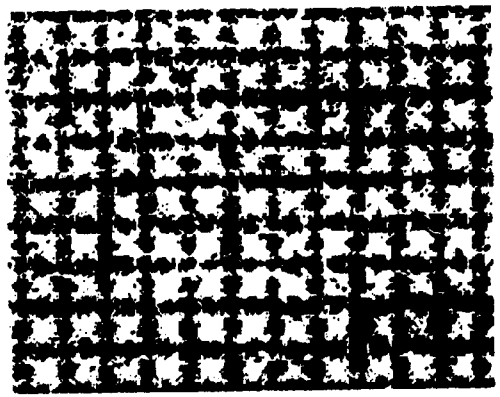
FIG. 9(*a*) is the toner image formed on the photosensitive member, in the first embodiment FIG. 9(*b*) is the toner image on the transfer medium when the photosensitive member was not exposed prior to transfer, in the first embodiment.
Figure 9B:
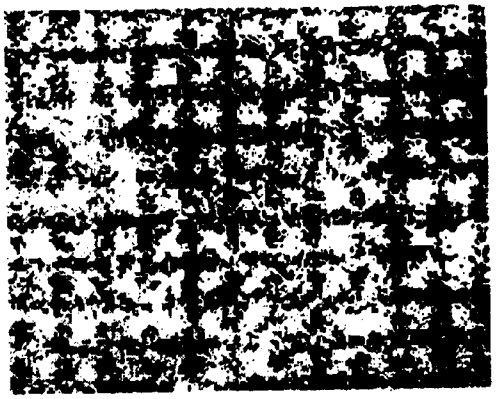
Figure 9A:
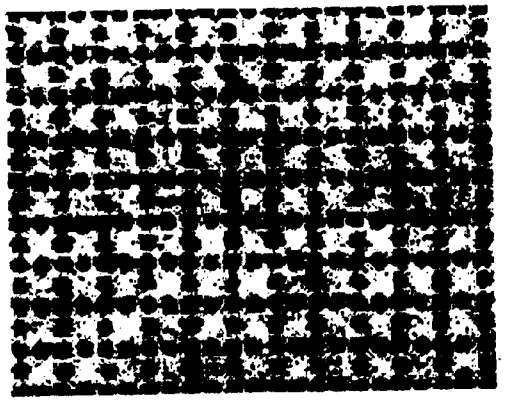

The results of the image formation carried out with the use of an image forming apparatus structured as described above are shown in FIGS. 9(*a*), 9(*b*), and 9(*c*). FIG. 9(*a*) shows a half-tone image developed on the induction type photosensitive member 11, proving that using an induction type photosensitive member 11 makes it possible to form a highly precise toner image, as described previously. FIG. 9(*b*) shows the toner image (transferred image) on the recording medium P which resulted from the transfer of the highly precise toner image illustrated in FIG. 9(*a*) onto the recording medium P without using the pretransfer exposure unit as the potential level difference reducing means 16. From this picture, it is evident that a substantial amount of toner was scattered and a transfer failure occurred. In other words, the preciseness which the toner image had when it was on the photosensitive member 11 cannot be seen on the transfer medium P, a sheet of ordinary paper.

FIG. 9(*c*) shows the toner image (transferred image) on the recording medium P which resulted from the transfer of the highly precise toner image on the induction type photosensitive member 11, illustrated in FIG. 9(*a*), onto the recording medium P (ordinary paper) using the pretransfer exposure unit as the potential level difference reducing means 16. From this picture, it is evident that the preciseness which the toner image had when it was on the photosensitive member 11 was almost intact even after the toner image had been transferred onto the transfer medium P.

Embodiment 2

Figure 10:
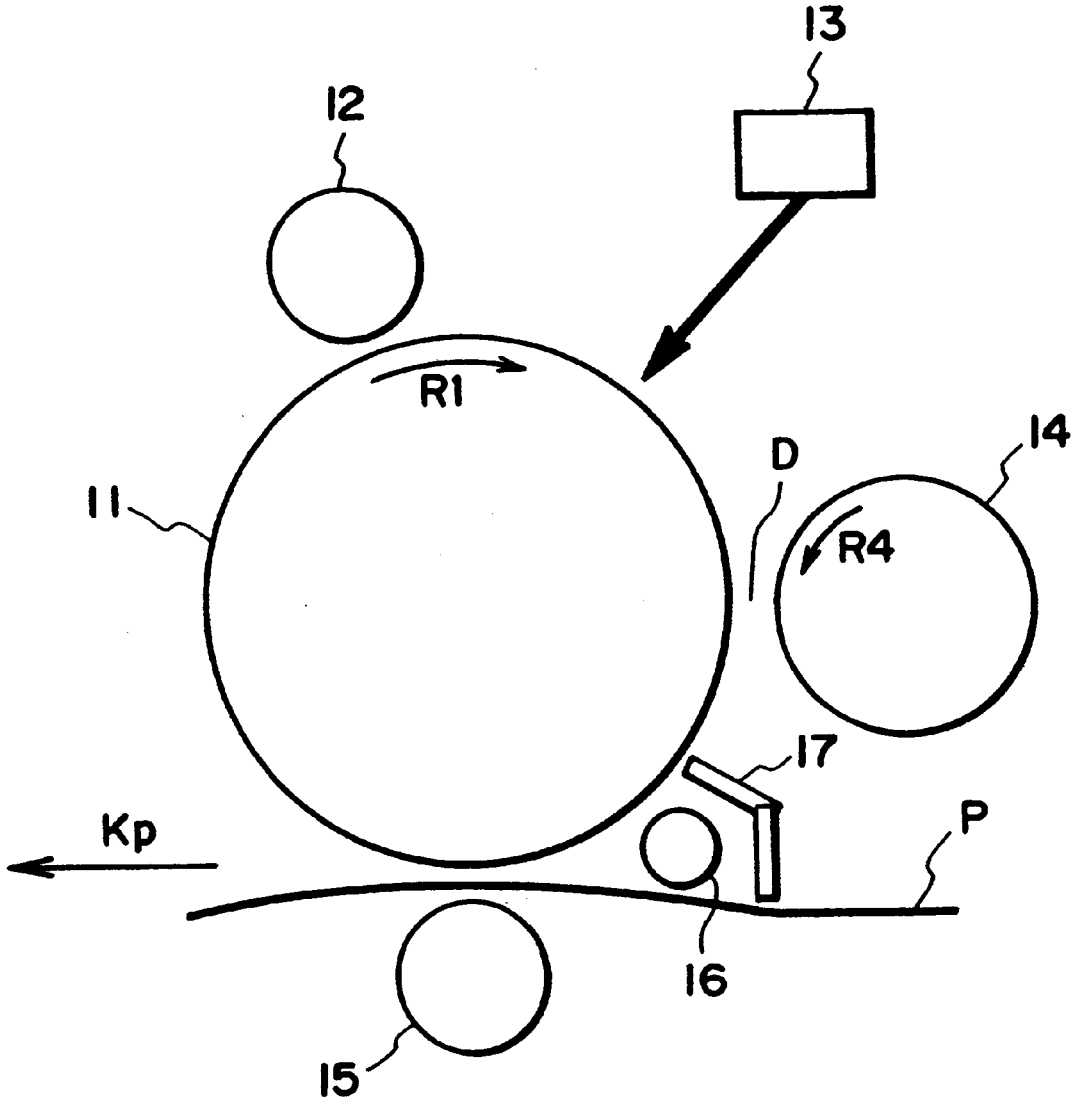
FIG. 10 is a schematic sectional view of the image forming apparatus in the second embodiment, and depicts the general structure of the apparatus.

FIG. 10 depicts the second embodiment of the present invention. In this embodiment, an exposure unit light blocking plate 17 was added to the structure in the first embodiment, so that the light for pretransfer exposure (pretransfer exposure light) was prevented from reaching the portion of the peripheral surface of the photosensitive member, in the development nip D. The exposure unit light blocking plate 17 may be constituted of any means as long as it can block the light with the same wave length as that of the pretransfer exposure light. Usage of a plate with high reflectance, for example, an aluminum plate, a stainless plate, a plastic plate coated with aluminum or the like by vapor deposition, or the like, can improve the efficiency of the pretransfer exposure. In this embodiment, a one millimeter thick aluminum plate was employed.

The amount of light to be emitted for pretransfer exposure is dependent upon the sensitivity of the induction type photosensitive member 11; it must be large enough to satisfactorily cancel the electrical charge on the peripheral surface of the photosensitive member. In other words, when a photosensitive member with poor sensitivity must be preexposed for transfer, a large amount of light must be emitted. As a result, the pretransfer exposure light invades as far as the development nip D, disturbing an electrostatic latent image which is being developed, which prevents the latent image from being properly developed.

However, when the structure in this embodiment was employed, even when a photosensitive material which was poor in sensitively, and therefore, required strong pretransfer exposure light was used, the photosensitive member could be preexposed for transfer without disturbing the electrostatic latent image on the photosensitive member, in the development nip D. Further, not only could a precise toner image be formed on the photosensitive member, but also, the toner image retained its preciseness even after it was transferred on the transfer medium P.

Embodiment 3

In this third embodiment, a corona based charging device (charging means) was employed in the place of the pretransfer exposure unit (light projecting means) employed as the potential level difference reducing means 16 in the first embodiment (FIG. 1).

With the use of the corona based charging device, the distribution pattern of the strong electric field generated immediately adjacent to the peripheral surface of the induction type photosensitive member 11 when an electrostatic latent image was formed on the peripheral surface of the photosensitive member, was flattened by charging the peripheral surface of the photosensitive member after the development, but prior to the transfer, to reduce the strength of the electric field which affected the toner, so that the toner image on the photosensitive member could be easily transferred onto the transfer medium P, that is, the toner particles 44 on the photosensitive member 11 could be desirably transferred.

More specifically, the corona based charging device in this embodiment comprised a corona wire, a shield, and a grid, and was used to charge the photosensitive member 11 so that, after the development, the surface potential level of the photosensitive member 11 became +500–+400 V, which was approximately the same as, or slightly lower than, the potential level of the photosensitive member 11 after the photosensitive member 11 was charged by the aforementioned charging device 12 for primary charge. Further, as the photosensitive member 11 was charged, the toner particles on the photosensitive member 11 were equalized in the amount of charge, which contributed to desirable transfer.

The functions and effects of this embodiment are approximately the same as those of the first embodiment.

Embodiment 4

Figure 11:
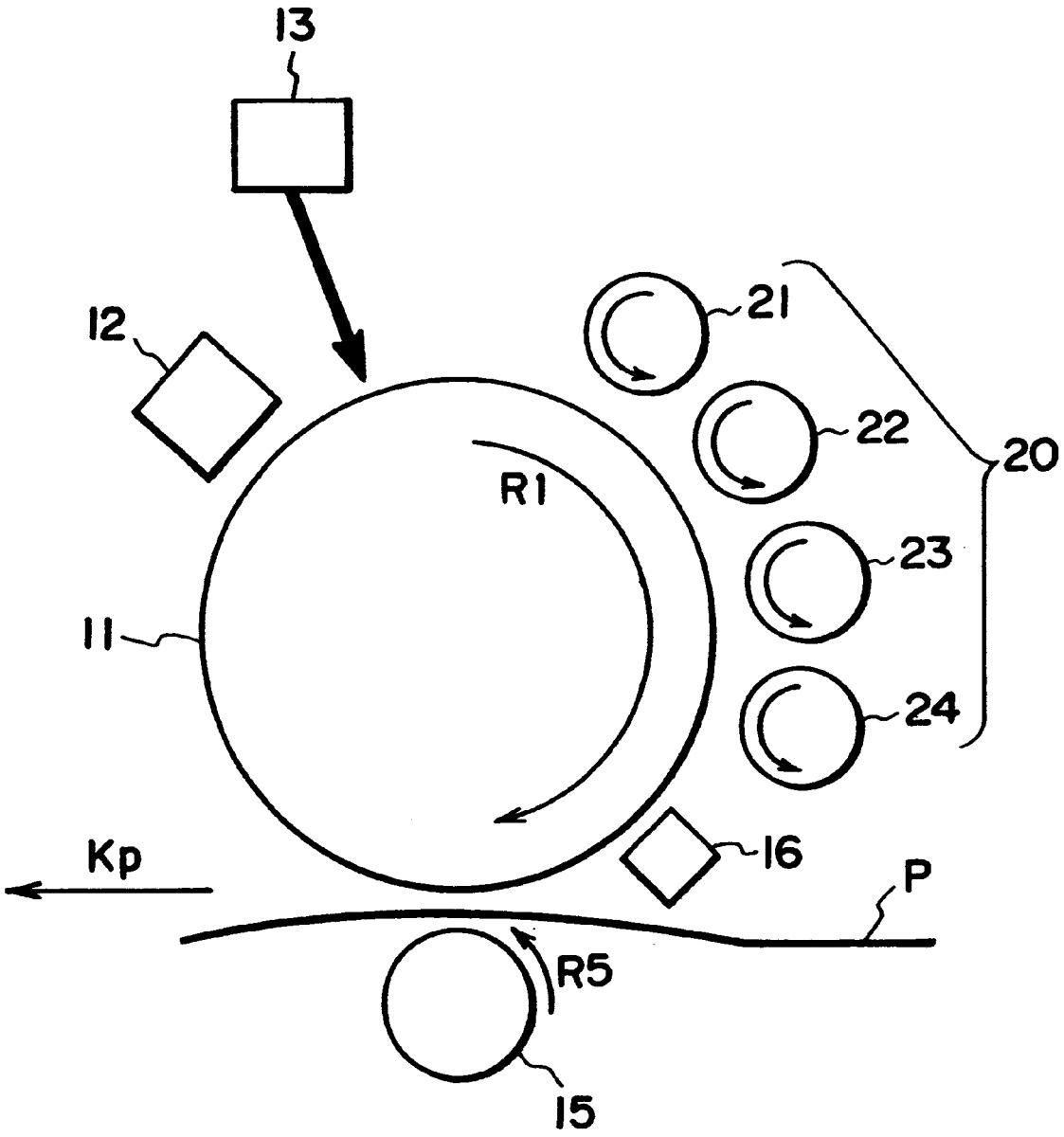
FIG. 11 is a schematic sectional view of the image forming apparatus in the fourth embodiment, and depicts the general structure of the apparatus.
Figure 12:
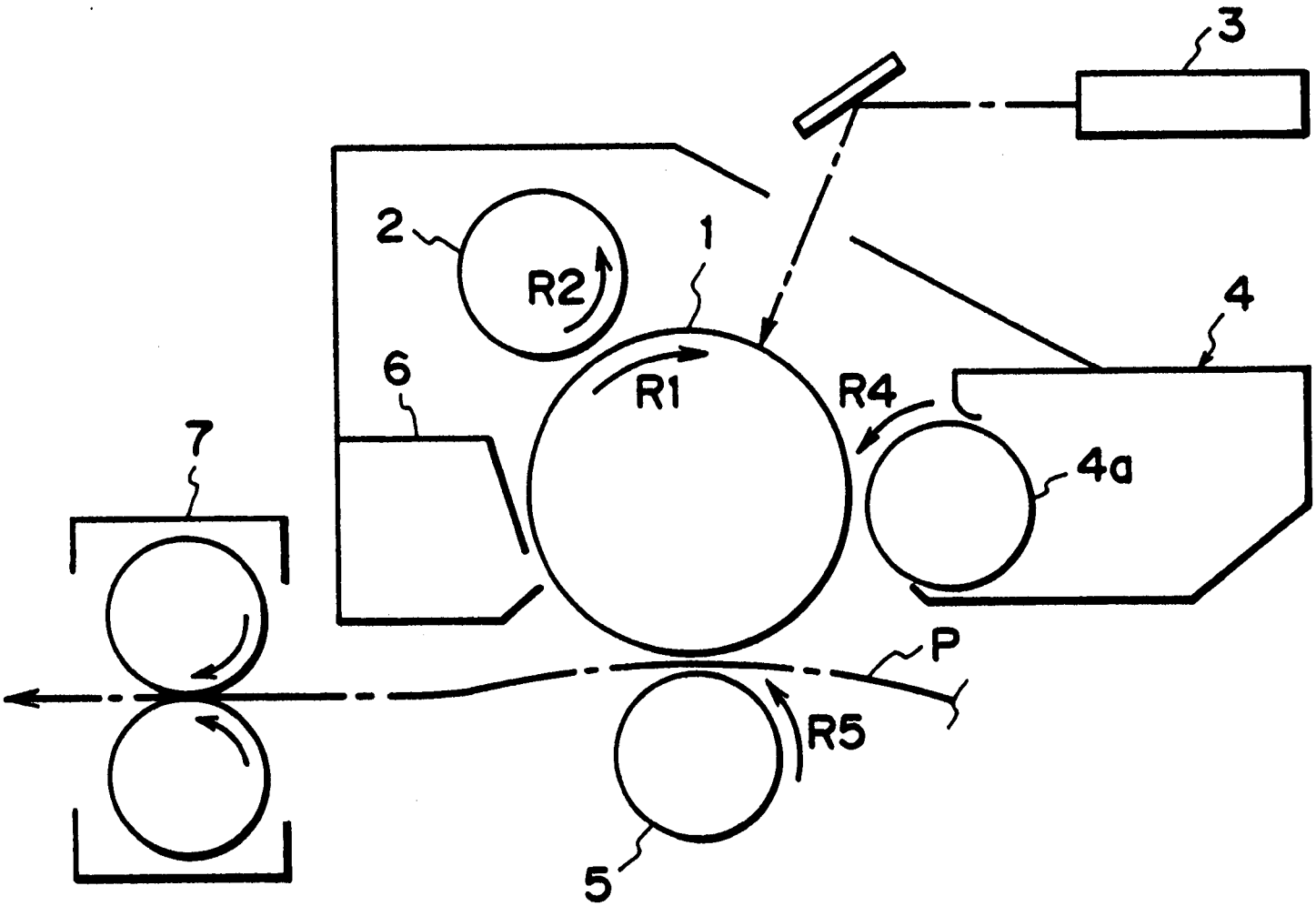
FIG. 12 is a schematic sectional view of a conventional image forming apparatus, and depicts the general structure of the apparatus.

This embodiment will be described with reference to FIG. 11. In this embodiment, the developing apparatus 20 comprised four developing devices 21, 22, 23, and 24, which contained yellow, magenta, cyan, and black toners, correspondingly. In operation, electrostatic latent images correspondent to yellow, magenta, cyan, and black colors, were consecutively formed on the peripheral surface of the induction type photosensitive member 11, and were consecutively developed by the corresponding color toners so that four toner images of different color were placed in layers on the peripheral surface of the photosensitive member 11. Then, the four toner images were transferred all at once onto the transfer medium P. Also in this embodiment, the toner particles on the induction type photosensitive member 11 were charged by a corona based charging device (charging means) as the potential level difference reducing means 16, prior to the transfer of the toner images.

As for the material for the photosensitive layer of the induction type photosensitive member 11, one part in weight of specially formulated CuPC pigment (Toyo Ink Co.) was dispersed in four parts in weight of hardening resin which belonged to the polyester-melamine group, and the mixture was coated to a thickness of 20 $\mu$m, as in the first embodiment.

As for the charging device 12 for primary charge, a corona based charging device comprising a corona wire, a shield, and an electric field controlling grid was employed to charge the peripheral surface of the photosensitive member to a potential level of +500 V. As for the optical system as the exposing means 13, a scanner type optical system, which comprised a semiconductor laser with a wave length of 680 nm and an output of 5 mW, and the spot size of which, in terms of the area within which light intensity was no less than $1/e^2$ of the peak intensity, was 25 $\mu$m in terms of the primary scanning direction, and 45 $\mu$m in terms of the secondary scanning direction, was used as in the first embodiment.

As for the developing system for the developing devices 21, 22, 23, and 24, a noncontact type developing system which used single component nonmagnetic toner was used; nonmagnetic toner was borne on the development sleeve while being regulated and charged, and carried to the development nip D, in which the toner was caused to fly to the peripheral surface of the photosensitive member 11 to develop an electrostatic latent image.

The toner image formed by the above described structure was charged with the use of the potential level difference reducing means 16 comprising the corona based charging device in this embodiment, so that the surface potential level of the photosensitive member 11 became +500–+400 V, which was approximately the same as, or slightly lower than, the potential level of the photosensitive member 11 after the photosensitive member 11 was charged by the aforementioned charging device 12 for primary charge. Further, as the photosensitive member 11 was charged, the toner particles on the photosensitive member 11 were equalized in the amount of charge, which contributed to desirable transfer.

With the provision of the above described structure, the preciseness which the toner image had when it was on the photosensitive member 11 was almost intact even after the toner image was transferred onto the transfer medium P.

While the invention has been described with reference to the structures disclosed herein, it is not confined to the details set forth, and this application is intended to cover such modifications or changes as may come within the purposes of the improvements or the scope of the following claims.

What is claimed is:

1. An electrophotographic apparatus comprising:

a photosensitive member;

electrostatic image forming means for forming an electrostatic image on said photosensitive member, said electrostatic image forming means including charging means for electrically charging said photosensitive member and first exposure means for exposing said photosensitive member charged by said charging means;

developing means for forming a toner image by developing the electrostatic image with toner;

transfer means for electrostatically transferring the toner image onto a transfer material;

wherein said photosensitive member has characteristics such that a rate of change of surface potential of said photosensitive member relative to a change of an exposure amount of said photosensitive member, is smaller in the case of a first exposure amount than in the case of a second exposure amount which is larger than in the first exposure amount; and reducing means for reducing a potential difference between a potential of said photosensitive member at the portion to which the toner is deposited and the potential of said photosensitive member of a portion to which the toner is not deposited, after a developing operation of said developing means and before a transfer operation of said transfer means, wherein said reducing means includes pretransfer exposure means for exposing said photosensitive member, wherein said pretransfer exposure means effects exposure of said photosensitive member with an exposure amount which is higher than a lower exposure amount side peak of a second order differential curve of a curve of plots of the surface potential of said photosensitive member relative to the exposure amount of said photosensitive member.

2. An apparatus according to claim 1, wherein a curve of plots of the surface potential of said photosensitive member relative to the exposure amount of said photosensitive member changes from convex-down to convex-up at an inflection point.

3. An apparatus according to claim 1, wherein said pre-transfer exposure means effects exposure of said photosensitive member with an exposure amount which is lower than a higher exposure amount side peak of a second-order differential curve of a curve of plots of the surface potential of said photosensitive member relative to the exposure amount of said photosensitive member.

4. An apparatus according to claim 1, wherein when said photosensitive member is exposed to light corresponding to one dot of resolution of the electrostatic image, 10 percent of a peak quantity of light of a distribution of a quantity of light is smaller than a light quantity at the lower exposure amount side peak of second-order differential curve.

5. An apparatus according to claim 1, wherein said reducing means includes a corona discharger.

6. An electrophotographic apparatus comprising:

a photosensitive member;

electrostatic image forming means for forming an electrostatic image on said photosensitive member, said electrostatic image forming means including charging means for electrically charging said photosensitive member and first exposure means for exposing said photosensitive member charged by said charging means;

developing means for forming a toner image by developing the electrostatic image with toner;

transfer means for electrostatically transferring the toner image onto a transfer material;

wherein said photosensitive member has characteristics such that a rate of change of surface potential of said photosensitive member relative to a change of an exposure amount of said photosensitive member, is smaller in the case of a first exposure amount than in the case of a second exposure amount which is larger than in the first exposure amount; and reducing means for reducing a potential difference between a potential of said photosensitive member at the portion to which the toner is deposited and the potential of said photosensitive member of a portion to which the toner is not deposited, after a developing operation of said developing means and before a transfer operation of said transfer means, wherein said reducing means includes pretransfer exposure means for exposing said photosensitive member, wherein said pretransfer exposure means effect exposure of said photosensitive member with an exposure amount which is lower than a higher exposure amount side peak of second order differential curve of a curve of plots of the surface potential of said photosensitive member relative to the exposure amount of said photosensitive member.

7. An apparatus according to claim 6, wherein a curve of plots of the surface potential of said photosensitive member relative to the exposure amount of said photosensitive member changes from convex-down to convex-up at an inflection point.

8. An apparatus according to claim 7, wherein when said photosensitive member is exposed to light corresponding to one dot of resolution of the electrostatic image, 10 percent of a peak quantity of light of a distribution of a quantity of the light is smaller than a light quantity at the lower exposure amount side peak of second order differential curve.

9. An electrophotographic apparatus comprising:

a photosensitive member;

electrostatic image forming means for forming an electrostatic image on said photosensitive member, said electrostatic image forming means including charging means for electrically charging said photosensitive member and first exposure means for exposing said photosensitive member charged by said charging means;

developing means for forming a toner image by developing the electrostatic image with toner;

transfer means for electrostatically transferring the toner image onto a transfer material;

wherein said photosensitive member has characteristics such that a rate of change of surface potential of said photosensitive member relative to a change of an exposure amount of said photosensitive member, is smaller in the case of a first exposure amount than in the case of a second exposure amount which is larger than in the first exposure amount; and reducing means for reducing a potential difference between a potential of said photosensitive member at the portion to which the toner is deposited and the potential of said photosensitive member of a portion to which the toner is not deposited, after a developing operation of said developing means and before a transfer operation of said transfer means, wherein when said photosensitive member is exposed to light corresponding to one dot of resolution of the electrostatic image, 10 percent of a peak quantity of light of a distribution of a quantity of the light is smaller than a light quantity at the lower exposure amount side peak of second order differential curve.

10. An apparatus according to claim 9, wherein a curve of plots of the surface potential of said photosensitive member relative to the exposure amount of said photosensitive member changes from convex-down to convex-up at an inflection point.

11. An apparatus according to claim 9, wherein said reducing means includes pretransfer exposure means for exposing said photosensitive member.

12. An apparatus according to claim 9, wherein said reducing means includes a corona discharge.

* * * * *

UNITED STATES PATENT AND TRADEMARK OFFICE

CERTIFICATE OF CORRECTION

PATENT NO. : 6,205,306 B1
DATED : March 20, 2001
INVENTOR(S) : Tomohito Ishida et al.

It is certified that error appears in the above-identified patent and that said Letters Patent is hereby corrected as shown below:

Column 1,
Line 36, "laser" should read -- laser beam, and is capable of forming such images as letters --; and
Line 46, "can not" should read -- cannot --.

Column 2,
Line 2, "can not" should read -- cannot --; and
Line 51, "pattern" should read -- patterns --.

Column 4,
Line 30, "embodiment" should read -- embodiment. --.

Column 6,
Line 41, "spaced" should read -- space --.

Column 7,
Line 3, "development sleeve 14" should read -- peripheral surface of the induction type, photosensitive member 11, and the potential level on the development sleeve 14 --; and
Line 4, "inclinations" should read -- inclination --.

Column 9,
Line 47, "Specifically" should read -- specifically --.

UNITED STATES PATENT AND TRADEMARK OFFICE

CERTIFICATE OF CORRECTION

PATENT NO. : 6,205,306 B1
DATED : March 20, 2001
INVENTOR(S) : Tomohito Ishida et al.

It is certified that error appears in the above-identified patent and that said Letters Patent is hereby corrected as shown below:

Column 12,
Line 22, "sensitively," should read -- sensitivity --.

Signed and Sealed this

Twenty-sixth Day of March, 2002

*Attest:*

*Attesting Officer*

JAMES E. ROGAN
*Director of the United States Patent and Trademark Office*